United States Patent [19]

Valtonen

[11] 3,937,544

[45] *Feb. 10, 1976

[54] ELECTRIC CURRENT SUPPLY CONDUIT AND A METHOD AND A DEVICE FOR PROVIDING SAME

[75] Inventor: Rainer Ilkka Tapio Valtonen, Soukka, Espoo, Finland

[73] Assignee: Oy Nokia AB, Helsinki, Finland

[ * ] Notice: The portion of the term of this patent subsequent to Aug. 20, 1991, has been disclaimed.

[22] Filed: Feb. 22, 1973

[21] Appl. No.: 334,883

[30] Foreign Application Priority Data

Dec. 15, 1972 Finland ..... 3555/72

[52] U.S. Cl. ..... 339/21 R

[51] Int. Cl.[2] ..... H01R 9/00

[58] Field of Search ..... 339/14, 20–24

[56] References Cited

UNITED STATES PATENTS

| | | | |
|---|---|---|---|
| 1,938,372 | 12/1933 | Brudie | 339/23 |
| 3,391,378 | 7/1968 | Fisher | 339/22 B |
| 3,601,748 | 8/1971 | Hart et al. | 339/14 R |
| 3,605,064 | 9/1971 | Routh et al. | 339/21 R |
| 3,622,938 | 11/1971 | Ito et al. | 339/21 R |
| 3,730,971 | 5/1973 | Durham et al. | 339/22 B |
| 3,778,746 | 12/1973 | Valtonen | 339/21 R |
| 3,831,130 | 8/1974 | Valtonen | 339/21 R |

*Primary Examiner*—Roy D. Frazier
*Assistant Examiner*—Robert A. Hafer
*Attorney, Agent, or Firm*—Haseltine, Lake & Waters

[57] ABSTRACT

An electric current supply conduit comprising a metal support rail of substantially U-shaped cross-section forming an open longitudinal channel. The support rail is provided with longitudinally extending current conductors fastened at the opposite side walls of the support rail. The ends of the current conductors are bent to project angularly, preferably perpendicularly with respect to the longitudinal direction of the support rail inwardly into said open channel of the support rail.

10 Claims, 9 Drawing Figures

Figure 1:
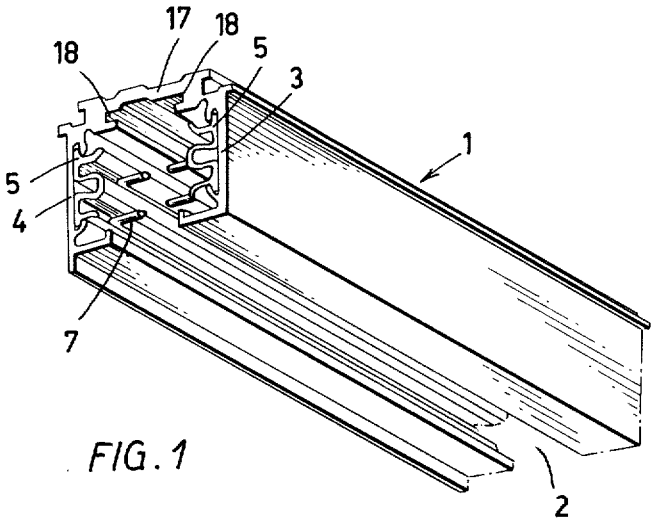

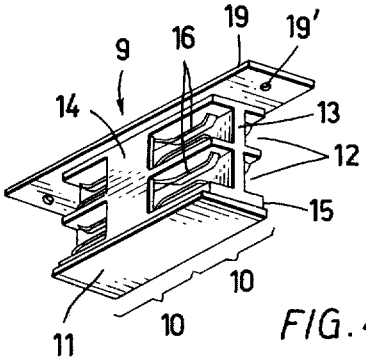
FIG. 4
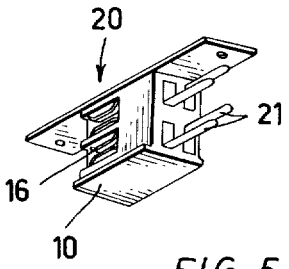
FIG. 5
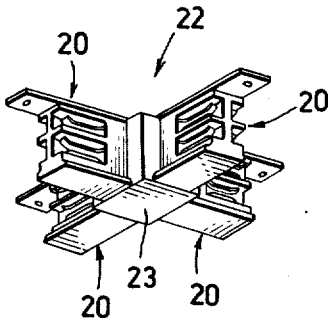
FIG. 6
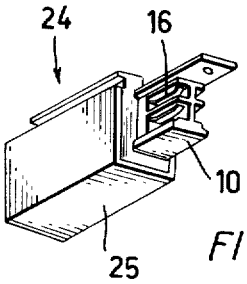
FIG. 7
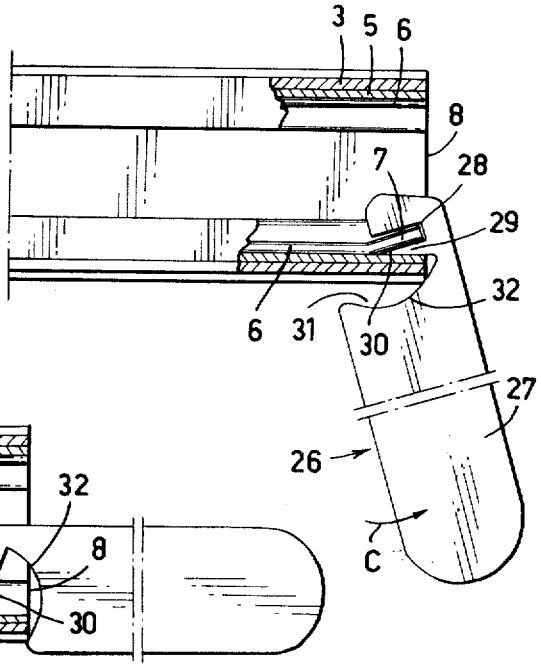
FIG. 8
FIG. 9
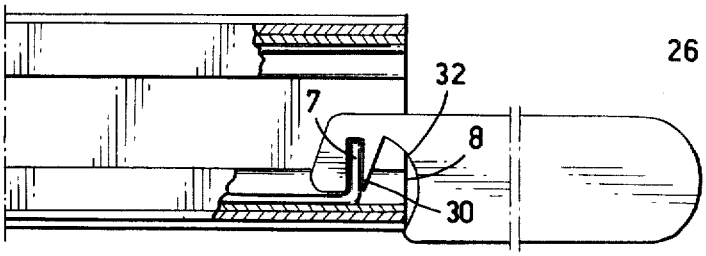

ELECTRIC CURRENT SUPPLY CONDUIT AND A METHOD AND A DEVICE FOR PROVIDING SAME

The present invention relates to an electric current supply conduit comprising a metal support rail forming an open longitudinal channel and longitudinally extending current conductors fastened at the support rail, whereby a coupling element can be removably inserted in the end of the support rail in order to make contact between contact fingers of the element and the ends of the current conductors.

Several similar types of current conduit are already known. The current conductors in these types are usually located on both side walls of an open longitudinal channel in a U-shaped support rail through the intermediate of insulating plastics strips. Supply conduits have been manufactured in certain standard lengths from which the required supply conduit systems have been constructed at the installation site, by means of specially designed couplers. The ends of the standard lengths have been so prepared at the factory that the plastics insulation strips extend approx. 5–15 mm beyond the end of the metal support rail and the current conductors likewise extend another 5–15 mm beyond the ends of the plastics insulating strips. The ends of the conductors thus fit directly into the couplers being used.

It is almost impossible to cut and prepare a ready made supply conduit on site without damaging the insulation strips or the current conductors. However, it would be most desirable for the supply conduits to be delivered in only a few standard lengths from which the required lengths could then be cut to fit the supply conduit system.

The simplest solution here would be that the supply conduits could be cut perpendicularly to their lengths and the couplers attached directly to the end of the supply conduit in this way cut. The thickness of the insulating strip in current supply conduits is, however, generally so small that the length of the leakage path between the conductors and the rail over the cut surface of the insulating strip, i.e. the uninsulated distance from the conductors to the support rail along the cut surface of the insulation, would be too short at the ends of supply rails cut perpendicularly.

In one known design of current supply conduit this problem has been solved by leaving an air gap between the insulation strip and the support rail. When terminating rails or joining them together, an insulating piece, projecting from the coupler or the terminating plug, is inserted in this gap. The length of the leakage path is thus increased by the length of the insulating piece. The insertion of separate insulating pieces may, however, be easily forgotten, which may cause a serious risk.

In another known design a solution of the leakage path problem has been attempted by cutting off a desired length at the end of each current conductor so as to increase the distance of the end of the current conductor from the end of the cut current supply conduit. Cutting off the current conductors embedded in the insulating strips inside the current conduit is, however, highly troublesome and almost unexceptionally causes damage to the plastics insulating strip.

An object of the present invention is to eliminate the said disadvantages and to provide a supply conduit which can be easily cut to required lengths on site and the ends of which can by simple operations be made suitable for being connected at the same time as the leakage path can be increased sufficiently.

This aim is achieved by means of a current supply conduit in accordance with the invention, which is characterized in that the current conductors are at least at one end bent into an angle so as to project into the said open channel of the support rail.

One advantage of the supply conduit in accordance with the invention is that the supply conduit can be cut by sawing the support rail including the insulation strips and current conductors perpendicularly in two and that the leakage path of the current conductors, i.e. the distances of their cut ends from the cut end surface of the metallic support rail, can, nevertheless, be made long enough without having to use separate insulating parts or without the current conductors having to be shortened by cutting off a certain length from them. This has been achieved so that the ends of the current conductors, after the support rail has been cut to desired length, have been bent away from the end surface of the support rail, preferably into a position perpendicular to the longitudinal direction of the current conductors. Such bending of the ends of the current conductors can be done easily by means of a simple tool without any risk of the bending damaging the plastics insulation strip.

Another subject of the invention is a coupling element for an electric current supply conduit in accordance with the invention, which element comprises a body that can be removably inserted in the said open channel at the end of the support rail, which body is provided with contacts for connecting the current conductors. This coupling element is characterized in that the contacts have been arranged so as to be resilient in a longitudinal plane perpendicular to the bottom of the support rail. Such a coupling element can be designed as a coupling box, supply box, or as a contact piece for the supply conduit. In the coupling element the contacts can be made plier-like so that the ends of the current conductors are clamped between contact tongues. In this way the contacts do not press the current conductor against the plastics insulating strip, which would be less desirable out of reasons of safety, should the plastics become softer out of some reason.

Further subjects of the invention are a method and a tool for preparing the supply conduit in accordance with the invention, and they are characterized in what is presented in claims 11 and 13, respectively.

Figure 2:
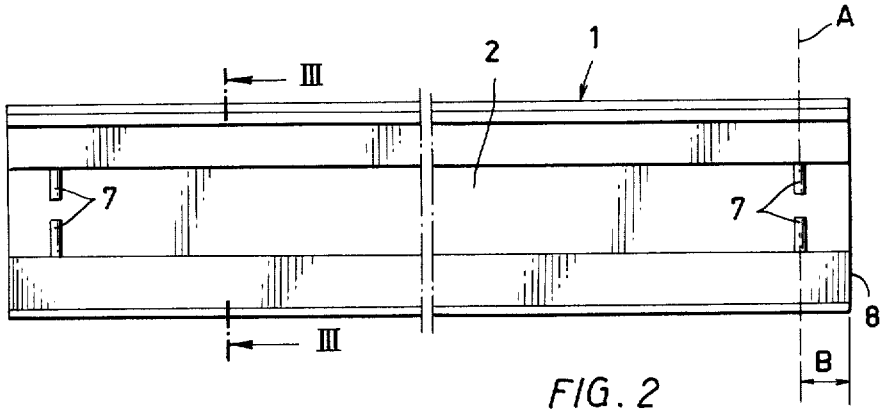
Figure 3:
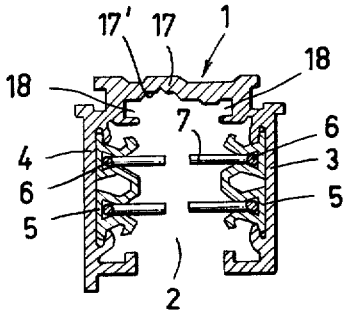

The invention will be described more closely below under reference to the attached drawings, wherein FIG. 1 is a perspective view of a favourable embodiment of a current supply conduit in accordance with the invention, FIG. 2 shows the supply conduit as viewed from below, FIG. 3 shows a section along the line III—III in FIG. 2, FIG. 4 is a perspective view of an embodiment of the coupling element in accordance with the invention as designed as a coupling box, FIG. 5 also shows a coupling element, as designed as a contact piece, FIG. 6 also shows a coupling element, as designed as a X coupling box, FIG. 7 also shows a coupling element, as designed as a supply box, and FIGS. 8 and 9 show an embodiment of the tool suitable for the preparation of the supply conduit in accordance with the invention at the beginning and at the end of the bending operation, respectively, with the supply conduit being shown partly as a section.

The current supply conduit shown in FIGS. 1 to 3 comprises a metallic support rail 1, acting as a support construction and being, for example, an extruded aluminium section. The support rail has a U section and forms a longitudinal open channel 2 for the insertion of the current connecting plug. The two side walls 3, 4 of the support rail are provided with longitudinal plastics insulating strips 5, in whose longitudinal grooves current conductors 6, for example of copper, are embedded. Such a supply conduit and a connecting plug designed for same are described, for example in the Finnish Pat. No. 40,644.

According to the invention, the end 7 of each current conductor is bent so as to be positioned in substantially the same level A, perpendicular to the longitudinal direction of the support rail (FIG. 2), which plane is at a distance B (FIG. 2) inwards from the cutting surface 8 of the support rail. Thus the ends of the current conductors extend mutually parallelly towards each other and project from the insulating strips 5 into the open channel 2 of the support rail.

It is noticed that in this way the supply conduit can be cut off through the support rail, insulating strips and current conductors and the ends of the current conductors be bent perpendicularly to the longitudinal direction of the current supply conduit at both ends of the supply conduit.

FIG. 4 of the drawings shows a coupling box suitable for a current supply conduit of the type described above, which box is intended for coupling two supply conduits together end to end. Here the coupling box 9 in principle consists of two combined coupling elements of opposite directions 10, the said element comprising a parallellopiped-shaped body 11 provided with a number of contact socket holes 12, which are in pairs open towards one end face 13 and towards one side face 14 or 15, respectively, as comes out from FIG. 4. Each socket hole is provided with a contact 16, which is fastened resiliently onto the body 11 so that the plier-shaped contact tongues of the contact spring in planes parallel to the side faces 14, 15 of the body.

The coupling box is intended to be pushed halfway into the end of the support rail of the supply conduit so that the side faces 14, 15 of the body are parallel with the side walls 3, 4 of the support rail and the resilient fastening plate 19 fastened to the body is parallel with the bottom wall 17 (FIG. 3) of the support rail. The depth of the contact holes 12 is here dimensioned so as to substantially correspond to the bending distance B (FIG. 2) of the current conductors.

The bottom wall of the support rail is provided with longitudinal guide grooves 18 for insertion of the fastening plate 19. The coupling box can be fastened to the support rail of the two supply conduits to be coupled together by means of screws threaded into the holes 19' at the ends of the fastening plate 19. Both coupling pieces of the coupling box may be provided with a projection or any other stopper that tosses against the end of the current conductor unless the end of the current conductor has been bent into an angle in the way described above. In this way it is possible to prevent the coupling box from being inserted into the supply conduit if one or more current conductors have not been bent.

In order to make sure that the coupling element can be inserted in the support rail in one correct position only, the inside surface of the bottom wall 17 of the support rail 1 is provided with a recess 17', which makes the inside surface asymmetrical. By also designing the corresponding surface section of the coupling element as asymmetrical, it is achieved that the coupling element can be inserted in the guide grooves 18 only with a certain one of its ends heading, which produces correct connections with the current conductors.

FIG. 5 shows a contact piece 20 in principle comprising a coupling element 10 of the type described above, to the contacts 16 of which connectors 21 projecting from the body have been fastened.

FIG. 6 shows an X coupling box 22 assembled out of contact pieces 20 in accordance with FIG. 5, whereby the connectors 21 of the contact pieces have been removably inserted into corresponding socket holes of a separate center block 23. The center block may be of the type described in the Finnish Patent Application No. 2491/71.

FIG. 7 shows a supply box 24 in principle comprising a coupling element 10 of the type described above, which element is fastened to a contact box 25 that is provided with connectors for connecting with an outside source of electricity, which connectors have been connected to the contacts 16 of the coupling element 10.

FIGS. 8 and 9 show a tool 26 in accordance with the invention for bending the ends of the current conductors. The tool comprises a flat body 27, one end of which is provided with a slit 28, the width of which substantially corresponds to the diameter of the current conductor 6 and the depth of which corresponds to the desired bending length B (FIG. 2) of the end 7 of the current conductor. One branch 29 of the slit 28 ends at a sharp point 30. The branch 29 is related to a curved recess 31, the radius of which substantially corresponds to the depth of the slit.

After the supply conduit has been cut off, the point 30 of the branch 29 is inserted in the groove of the insulating strip 5 underneath the current conductor 6 until the end of the current conductor presses against the bottom of the slit 28 and the cutting surface 8 of the support rail is pressed against the bottom of the recess 31. Hereafter the body is turned in the direction of the arrow C so that the bottom edge 32 of the recess 31 glides along the cutting surface 8 of the support rail until the end 7 of the current conductor has been bent by about 90° projecting into the longitudinal channel 2 of the support rail. The tool can then be easily removed from the current conductor. This procedure is carried out for each end of current conductor at both ends of the support rail.

The drawings and the related specification are only intended to illustrate the idea of the invention. In its details the current supply conduit in accordance with the invention may show even considerable variation within the patent claims.

What I claim is:

1. An electric current supply arrangement comprising, in combination, a metal support rail forming an open longitudinal channel and longitudinally extending current conductors fixed in their longitudinal direction fastened at the support rail, and a coupling element removably inserted in the end of the support rail to make contact between contact fingers of the element and the ends of the current conductors, the ends of said current conductors being bent perpendicularly to the longitudinal direction of said conductors so as to extend parallelly towards each other.

2. An electric current supply arrangement comprising, in combination, a metal support rail forming an open longitudinal channel and longitudinally extending current conductors fixed in their longitudinal direction fastened at the support rail, and a coupling element removably inserted in the end of the support rail to make contact between contact fingers of the element and the ends of the current conductors, said current conductors being at least bent into an angle at one end so as to be positioned inwardly with respect to their longitudinal axis, said bent ends located at equal distances inside the end surface of said support rail.

3. An electric current supply arrangement comprising, in combination, a metal support rail forming an open longitudinal channel and longitudinally extending current conductors fixed in their longitudinal direction fastened at the support rail, and a coupling element removably inserted in the end of the support rail to make contact between contact fingers of the element and the ends of the current conductors, said current conductors being at least bent into an angle at one end so as to be positioned inwardly with respect to their longitudinal axis, the bottom section of said support rail has opposite longitudinal guide grooves for fastening the coupling element to the support rail.

4. An electric current supply arrangement comprising, in combination, a metal support rail forming an open longitudinal channel and longitudinally extending current conductors fixed in their longitudinal direction fastened at the support rail, and a coupling element removably inserted in the end of the support rail to make contact between contact fingers of the element and the ends of the current conductors, said current conductors being at least bent into an angle at one end so as to be positioned inwardly with respect to their longitudinal axis, the inside surface of the bottom of said support rail having means which permits the coupling element to be inserted in the support rail in a predetermined position.

5. An electric current supply arrangement comprising, in combination, a metal support rail forming an open longitudinal channel and longitudinally extending current conductors fixed in their longitudinal direction fastened at the support rail, and a coupling element removably inserted in the end of the support rail to make contact between contact fingers of the element and the ends of the current conductors, said current conductors being at least bent into an angle at one end so as to be positioned inwardly with respect to their longitudinal axis, said coupling element having contacts for connecting said current conductors, said contacts being resilient in a longitudinal plane perpendicular to the bottom of said support rail.

6. An arrangement as defined in claim 5 wherein said contacts are embedded in a body substantially of the shape of a parallellopiped, each contact having a contact socket hole in said body and opening towards one end surface and towards one side surface of the body.

7. An arrangement as defined in claim 6 wherein said contacts are plier-shaped contact tongues.

8. An arrangement as defined in claim 5 wherein said coupling element has a resilient fastening plate dimensioned so as to fit and glide in the longitudinal guide grooves fitted into said support rail.

9. An arrangement as defined in claim 5 including contact holes with projecting connectors, said coupling element being at its end facing away from said contact holes with said projecting connectors.

10. An arrangement as defined in claim 5 including contact holes coupled to another coupling element, said coupling element being at its end facing away from said contact holes coupled to another coupling element.

* * * * *